US005257948A

United States Patent [19]

Peterson

[11] Patent Number: 5,257,948

[45] Date of Patent: Nov. 2, 1993

[54] PRINTED CIRCUIT BOARD MOUNTING DEVICE FOR ELECTRICAL CONNECTORS

[75] Inventor: Bruce A. Peterson, Schaumburg, Ill.

[73] Assignee: Molex Incorporated, Lisle, Ill.

[21] Appl. No.: 989,687

[22] Filed: Dec. 14, 1992

[51] Int. Cl.[5] ..... H01R 13/00

[52] U.S. Cl. ..... 439/571

[58] Field of Search ..... 439/59-62, 439/65, 74, 76, 567, 569, 570, 571, 572

[56] References Cited

U.S. PATENT DOCUMENTS

| | | | |
|---|---|---|---|
| 4,668,040 | 5/1987 | Matsuzaki et al. | 339/125 R |
| 4,681,389 | 7/1987 | Nakazawa et al. | 439/557 |
| 4,943,244 | 7/1990 | Teck et al. | 439/571 |
| 5,037,316 | 8/1991 | Fukushima et al. | 439/83 |
| 5,120,232 | 6/1992 | Korunsky | 439/108 |

*Primary Examiner*—Joseph H. McGlynn
*Attorney, Agent, or Firm*—Stephen Z. Weiss

[57] ABSTRACT

An electrical connector is provided for mounting on the surface of a printed circuit board. The connector includes a dielectric housing for mounting a plurality of terminals connectable to appropriate circuit traces on the circuit board. A board mounting clip is mounted on the housing for mounting the connector on the surface of the circuit board. The mounting clip includes a C-shaped portion defining an upper leg and a lower leg respectively insertable into a pair of slots in the housing. At least one of the slots includes a ramped leading edge adapted to engage the free end of a respective one of the legs to bias the board mounting device into firm position on the housing.

12 Claims, 1 Drawing Sheet

PRINTED CIRCUIT BOARD MOUNTING DEVICE FOR ELECTRICAL CONNECTORS

FIELD OF THE INVENTION

This invention generally relates to the art of electrical connectors and, particularly, to systems for surface mounting electrical connectors on printed circuit boards or the like.

BACKGROUND OF THE INVENTION

There are a wide variety of electrical connectors which are adapted for mounting to a printed circuit board and interconnecting the terminals of a connector to the circuit traces on the board. One type of such a connector is mounted to one side or surface of the board. The terminals, themselves, may be interconnected, as by soldering, to surface contact pads on the board, or the terminals may have solder tails for projecting through holes in the board for soldering to circuit traces on the board or in the holes.

Most such electrical connectors have some form of board mounting system or devices for retaining a connector on a printed circuit board, such devices often being called "board locks". These devices often include board-locking pegs projecting through mounting holes in the circuit board, the pegs often being bifurcated to define a pair of resilient legs having hook portions for locking the connector to the board. Such board locks may be provided as permanent locking devices, or they may be provided as temporary retaining means to maintain a proper position of the connector during soldering of the terminals to the contact pads or circuit traces on the board.

One of the problems with board mounting devices or "board locks" of the character described above, is in maintaining the devices in firm positions on the connector so that the connector does not move during soldering operations. A loose mounting or an imprecise mounting of the connector on the circuit board can result in unacceptable or defective interconnections between the connector terminals and the contact pads or circuit traces on the board. Heretofore, considerable efforts have been made in concentrating on the structure of the mounting pegs of the board locks in order to achieve proper connector positioning. However, even if the mounting pegs are firmly and properly locked to the board, the connector still may be loose or out of position if the mounting device, itself, is not firmly positioned on the connector.

Another consideration in designing board mounting devices or board locks of the character described above, involves simplicity and rendering such connector assemblies cost effective. Sometimes, the provision of board mounting devices add considerably to either the costs of the connector assembly, itself, or to the costs in assembling or manufacturing the assembly. This invention is directed to solving these problems by providing a very functionally effective as well as a very cost effective printed circuit board mounting device for such electrical connectors.

SUMMARY OF THE INVENTION

An object, therefore, of the invention is to provide a new and improved device for mounting an electrical connector on a printed circuit board.

In the exemplary embodiment of the invention, the disclosed electrical connector includes a dielectric housing for mounting a plurality of terminals connectable to appropriate circuit traces on a printed circuit board. The connector includes a board mounting device on the housing for mounting the connector on the surface of the circuit board. The invention contemplates that the board mounting device includes a C-shaped portion defining an upper leg and a lower leg respectively insertable into a pair of slots in the housing from the exterior thereof. At least one of the slots includes a ramped leading edge adapted to engage the free end of a respective one of the legs to bias the board mounting device into firm position on the housing.

As disclosed herein, both of the slots in the housing include ramped leading edges adapted to respectively engage the free ends of both legs of the C-shaped portion of the board mounting device. The lower leg is longer than the upper leg, and board locking means are provided projecting from the lower leg for mounting the connector to the printed circuit board.

Another feature of the invention, generally, involves the provision of complementary interengaging means between the lower leg and the housing to prevent removal of the board mounting device from the housing. As disclosed herein, the complementary interengaging means comprise a tab projecting from the lower leg and adapted to be bent behind a shoulder of the housing after the lower leg is inserted into its respective slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
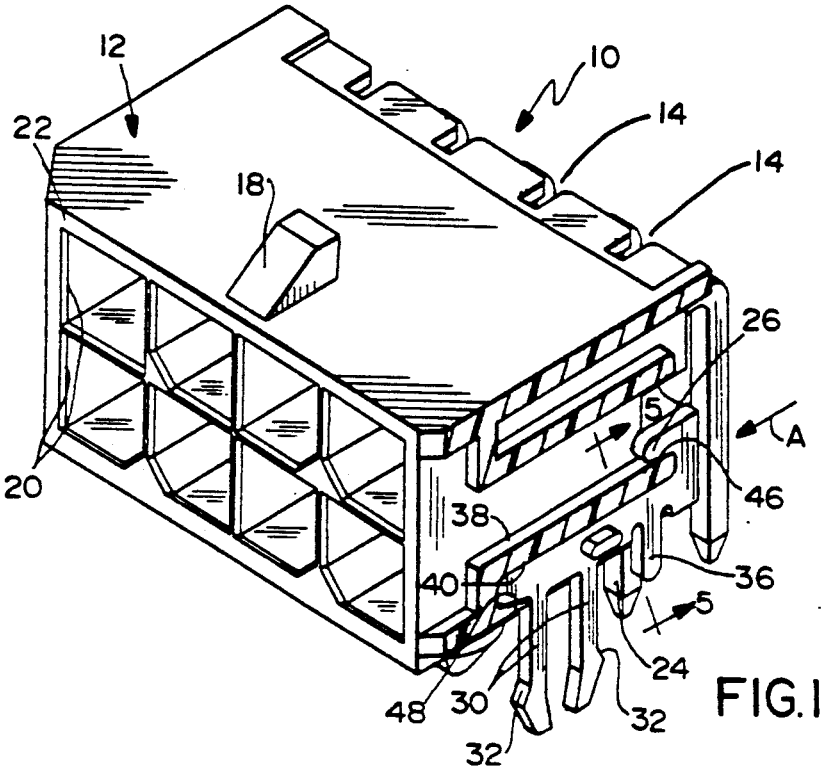
FIG. 1 is a perspective view, partially in section, of an electrical connector embodying a board mounting device according to the invention.

Referring to the drawings in greater detail, and first to Figure the invention is incorporated in an electrical connector, generally designated 10, for mounting on the surface of a printed circuit board (not shown). The connector includes a dielectric housing, generally designated 12, unitarily molded of insulating material such as plastic or the like. The housing mounts a plurality of terminals, generally designated 14, which are connectable to appropriate circuit traces on the circuit board. The housing also mounts at least one board mounting device, generally designated 16, for mounting connector 10 on the surface of the circuit board.

More particularly, housing 10 includes a ramped latch boss 18 projecting from the top thereof for latching with a complementary connector (not shown). The complementary connector will include a plurality of terminal mounting silos for insertion into a plurality of receptacles or passages 20 in housing 12, the passages opening at a front mating face 22 of the housing. Although not visible in FIG. 1, connectors 10 have contact pins projecting into passages 20 for mating with respective female terminals of the complementary connector. Each terminal 14 also has a solder tail 24 extending at a right-angle to its respective contact pin for insertion into a hole in the printed circuit board for soldering to a circuit trace on the board or in the hole.

Figure 2:
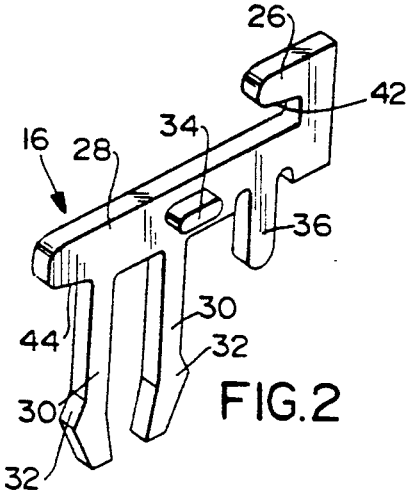
FIG. 2 is a perspective view of the board mounting device.
Figure 4:
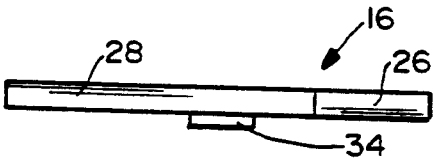
FIG. 4 is a top plan view of the board mounting device.
Figure 3:
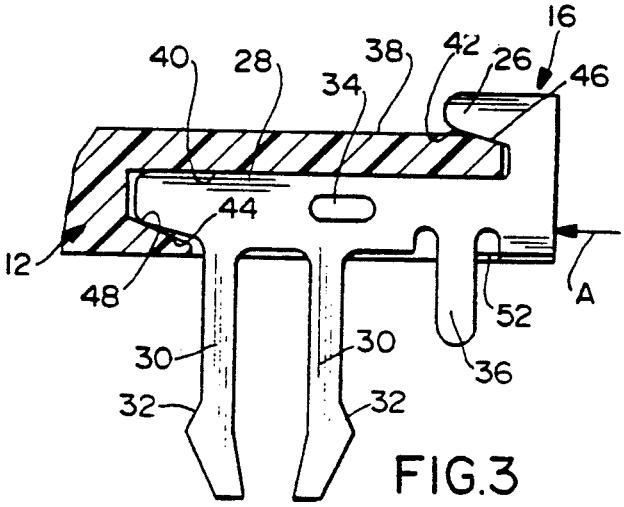
FIG. 3 is a side elevational view of the board mounting device, along with fragmented sections of the adjacent housing area.

Referring to FIGS. 2–4 in conjunction with FIG. 1, board mounting device 16 includes a generally C-shaped upper portion defining an upper leg 26 and a lower leg 28. Upper leg 26 is shorter than lower leg 28 and, therefore, forms a relatively rigid portion of the device. A pair of flexible arms 30 project downwardly from lower leg 28 for insertion into a mounting hole in the printed circuit board. Each leg has an outwardly directed shoulder 32 for engaging against the opposite surface of the board to lock connector 10 to the board. A nib 34 is formed to project outwardly from one side of lower leg 28 for sliding in a guide groove (not shown) in connector housing 12. Lastly, a locking tab 36 projects downwardly from lower leg 28, and the locking tab is adapted to be bent behind a shoulder of the housing after the board mounting device is properly positioned in the housing, as described below in relation to FIG. 5.

At this point, it should be understood that, although only one board mounting device 16 is shown in FIG. 1, a plurality of such board locking devices may be provided, particularly if housing 12 of the connector is relatively long and mounts a relatively large number of terminals 14. In addition, such terms as "upper", "lower", "downwardly", etc. are used herein and in the claims hereof in order to provide a clear and concise description and understanding of the invention, as depicted in the orientation of the connector in the drawings. However, it should be understood that such terms are not used to be limiting, because the connector is omnidirectional in function and actual use. Lastly, to facilitate manufacture, each board mounting device 16 may be unitarily fabricated from stamped and formed sheet metal material.

Referring to FIG. 3 in conjunction with FIG. 4, generally, means are provided between each board mounting device 16 and housing 12 of connector 10 to ensure that the board mounting device is firmly positioned on the housing. More particularly, upper leg 26 of the device is inserted into a slot 38 in housing 12, and lower leg 28 is inserted into a slot 40 of the housing. The lower edge of upper leg 26 is angled, as at 42. The lower edge of lower leg 28 is angled, as at 44. Upper slot 38 includes a ramped leading edge for engaging the free end of upper leg 26 when the upper leg is inserted into slot 38. Similarly, slot 40 has a ramped leading edge 48 for engaging the free end of lower leg 28 when the lower leg is inserted into slot 40.

Therefore, each board mounting device 16 is very easily assembled to housing 12 of connector 10 in the direction of arrows "A" (FIGS. 1 and 2) from the rear of the connector, slots 38 and 40 opening in that insertion direction. It can be seen that the mounting devices are very simply assembled to the connector from the exterior thereof. As the mounting device is moved in the direction of arrows "A", upper leg 26 moves into slot 38 and lower leg 28 moves into slot 40, whereupon angled edges 42 and 44 of the upper and lower legs, respectively, engage ramped surfaces 46 and 48 of the housing, respectively. When the mounting device is moved or inserted to its fully assembled position as shown in FIGS. 1 and 3, the free end of lower leg 28 becomes wedged between ramped surface 48 and the upper run of slot 40. In addition, shorter and stiffer upper leg 26 engages ramped surface 46 to contribute to a firm positioning of the mounting device on the housing.

Figure 5:
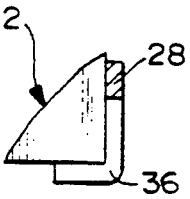
FIG. 5 is a fragmented section taken generally along line 5—5 of FIG. 1, but with the locking tab in its final bent position.

Finally, complementary interengaging means are provided between each board mounting device 16 and housing 12 to prevent removal of the mounting device from the housing, i.e. to prevent legs 26 and 28 of the mounting device from backing out of their firm engagement within slots 38 and 40, respectively. More particularly, as stated above, locking tab 36 projects downwardly from lower leg 28 when the mounting device is inserted into the housing. This initial condition of the locking tab is shown in FIGS. 1–3. In other words, the locking tab is stamped coplanar with the remainder of the mounting device. When the mounting device is in its full and firm, wedged position as shown in FIGS. 1 and 3, the locking tab is bent inwardly as shown in FIG. 5. As seen best in FIG. 3, a shoulder 52 is molded integral with housing 12. When locking tab 36 is bent from the position shown in FIGS. 1–3 to the position shown in FIG. 5, the locking tab is bent behind shoulder 52 so that the mounting device cannot back out of its assembled condition opposite the direction of arrows "A". Shoulder 52 is located so as not to interfere with insertion of the mounting device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector for mounting on the surface of a printed circuit board, including a dielectric housing for mounting a plurality of terminals connectable to appropriate circuit traces on the circuit board, and a board mounting device on the housing for mounting the connector on the surface of the circuit board, wherein the improvement comprises said board mounting device including a C-shaped portion defining an upper leg and a lower leg respectively insertable into a pair of slots in the housing, and at least one of the slots including a ramped leading edge adapted to engage the free end of a respective one of the legs to bias the board mounting device into firm position on the housing.

2. In an electrical connector as set forth in claim 1, wherein both said slots include ramped leading edges adapted to respectively engage the free ends of both legs of the C-shaped portion of the board mounting device.

3. In an electrical connector as set forth in claim 1, wherein one of said legs is longer than the other leg, and at least the slot into which the other leg is insertable includes a ramped leading edge engageable with the free end of the other leg.

4. In an electrical connector as set forth in claim 3, wherein said one leg comprises said lower leg.

5. In an electrical connector as set forth in claim 4, including board locking means projecting from said lower leg for mounting the connector to the printed circuit board.

6. In an electrical connector as set forth in claim 4, including complementary interengaging means between the lower leg and the housing to prevent removal of the board mounting device from the housing.

7. In an electrical connector as set forth in claim 6, wherein said complementary interengaging means comprise a tab projecting from the lower leg and adapted to be bent behind a shoulder of the housing after the lower leg is inserted into its respective slot.

8. An electrical connector for mounting on a printed circuit board, comprising:

a dielectric housing;

a board mounting clip mounted on the housing and including a pair of legs insertable into a pair of slots in the housing; and at least one of the slots including a ramped surface for engaging the free end of a respective one of the legs to bias the board mounting clip into a firm position on the housing.

9. An electrical connector as set forth in claim 8, wherein one of said legs is longer than the other leg, and at least the slot into which the other leg is insertable includes a ramped surface engageable with the free end of the other leg.

10. An electrical connector as set forth in claim 8, wherein said slots are open to the exterior of the housing for ready insertion thereinto of the legs of the board mounting clip.

11. An electrical connector as set forth in claim 8, including complementary interengaging means between the board mounting clip and the housing to prevent removal of the board mounting clip from the housing.

12. An electrical connector as set forth in claim 8, wherein said one of the legs of the board mounting clip includes an angled surface for engaging a ramped surface.

* * * * *